US011952924B1

(12) United States Patent
Yannone et al.

(10) Patent No.: US 11,952,924 B1
(45) Date of Patent: Apr. 9, 2024

(54) STRUCTURAL WINDAGE TRAY

(71) Applicant: FCA US LLC, Auburn Hills, MI (US)

(72) Inventors: Ronald Yannone, Sterling Heights, MI (US); Anthony J Denouden, Lake Orion, MI (US); Milorad A Kovac, Macomb Township, MI (US); Patrick Mutch, Southfield, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/298,554

(22) Filed: Apr. 11, 2023

(51) Int. Cl.
*F02B 77/00* (2006.01)
*F01M 11/00* (2006.01)

(52) U.S. Cl.
CPC ..... *F01M 11/00* (2013.01)

(58) Field of Classification Search
CPC ..... F01M 11/0004; F01M 2011/0033; F01M 2011/005; F01M 2011/002; F16F 15/264
USPC ..... 123/195 C
See application file for complete search history.

(56) References Cited

U.S. PATENT DOCUMENTS 4,911,118 A * 3/1990 Kageyama ..... F02F 7/0053 123/195 C
6,742,481 B2 * 6/2004 Baldwin ..... F01M 1/08 123/41.35
7,341,039 B1 * 3/2008 Jaszewski ..... F01M 11/0004 123/196 R
8,020,528 B1 * 9/2011 Phillips ..... F16F 15/267 123/196 R
8,302,577 B2 * 11/2012 Wunsch ..... F01M 11/0004 123/196 R
2005/0061284 A1 * 3/2005 Sato ..... F02B 75/06 123/192.2
2005/0279316 A1 * 12/2005 Rice ..... F01M 11/0004 123/196 R
2012/0067322 A1 * 3/2012 Andersson ..... F01M 11/0004 206/521

* cited by examiner

*Primary Examiner* — Long T Tran
*Assistant Examiner* — James J Kim
(74) *Attorney, Agent, or Firm* — Jeremy J. Klobucar

(57) ABSTRACT

A windage tray for an engine including a first body having a first coupling feature by which the first body is adapted to be coupled to an engine block. The first body having a second coupling feature by which the first body is adapted to be coupled to a bearing cap. The first body having a third coupling feature by which the first body is adapted to be coupled to a balance shaft module.

15 Claims, 3 Drawing Sheets

STRUCTURAL WINDAGE TRAY

FIELD

The present disclosure relates to a windage tray for an engine that is coupled to multiple engine components.

BACKGROUND

One of the main sources of noise, vibration and harshness (NVH) in a vehicle is the internal combustion engine (ICE). ICEs include a windage tray to separate part of a crank area of an engine piston from an oil sump to limit the effect of air movement within the crank area from oil in the engine, while still permitting oil flow to the oil sump. Windage trays are attached to a lower part of an engine housing, which may be called an engine block. In addition to the engine block, other components of the engine radiate noise and vibrations.

SUMMARY

In at least some implementations, a windage tray for an engine, the windage tray comprising a first body having a first coupling feature by which the first body is adapted to be coupled to an engine block, the first body having a second coupling feature by which the first body is adapted to be coupled to a bearing cap, and the first body having a third coupling feature by which the first body is adapted to be coupled to a balance shaft module.

In at least some implementations, the first body includes an inner surface adapted to overlie part of an interior of the engine block and an opposite outer surface, and a fluid passage formed through the first body and extending through the inner surface and the outer surface.

In at least some implementations, the third coupling feature includes one or more holes that extend perpendicular to at least one of the first coupling feature and the second coupling feature.

In at least some implementations, the first coupling feature includes holes through the first body and the second coupling feature includes holes through the first body.

In at least some implementations, the first body includes an inner surface adapted to overlie part of an interior of the engine block and an opposite outer surface, and the first coupling feature and the second coupling feature each including one or more holes that extend through the inner surface and the outer surface.

In at least some implementations, the one or more holes of the first coupling feature are each adapted to receive a fastener that is coupled to the engine block, and the one or more holes of the second coupling feature are each adapted to receive a fastener that is coupled to the bearing cap.

In at least some implementations, the first body extends in a longitudinal direction and a lateral direction, where the lateral direction is perpendicular to the longitudinal direction, and wherein the first coupling feature is arranged vertically and is adapted to receive a fastener that extends vertically into the engine block, where vertically is perpendicular to both the longitudinal direction and the lateral direction, and wherein a portion of the first body extends vertically and includes the third coupling feature which is arranged in the longitudinal direction.

In at least some implementations, the third coupling feature is vertically spaced from one or both of the first coupling feature and the second coupling feature.

In at least some implementations, the windage tray also comprises a second body, the second body being spaced from the first body, the second body having a first coupling feature by which the second body is adapted to be coupled to an engine block, the second body having a second coupling feature by which the second body is adapted to be coupled to a bearing cap, and the second body having a third coupling feature by which the second body is adapted to be coupled to a balance shaft module.

In at least some implementations, the third coupling feature of the second body includes one or more holes that extend perpendicular to at least one of the first coupling feature of the second body and the second coupling feature of the second body.

In at least some implementations, an engine assembly, comprising an engine block having a first end, a second end spaced in a longitudinal direction from the front side, a left side extending between the first end and the second end and a right side extending between the first end and the second end and spaced in a lateral direction from the left side, where the lateral direction is perpendicular to the longitudinal direction. The engine assembly further comprising a balance shaft module connected to the left side and the right side, a bearing cap attached to the engine block, and a windage tray including one or more first holes each of which receives a fastener that is coupled to the engine block, one or more second holes each of which receives a fastener coupled to the bearing cap, and one or more third holes, each of which receives a fastener coupled to the balance shaft module.

In at least some implementations, the one or more fasteners received in the one or more first holes are arranged in a vertical direction that is perpendicular to the longitudinal direction, and the one or more fasteners received in the one or more third holes are arranged perpendicular to the one or more fasteners received in the one or more first holes.

In at least some implementations, the one or more fasteners received in the one or more second holes are arranged in a vertical direction that is perpendicular to the longitudinal direction and the lateral direction, and the one or more fasteners received in the one or more third holes are arranged perpendicular to the one or more fasteners received in the one or more second holes.

In at least some implementations, the windage tray includes a first windage tray and a separate second windage tray spaced longitudinally from the first windage tray, wherein the second windage tray is coupled by fasteners to each of the engine block, the balance shaft module and at least one bearing cap that is separate from the at least one bearing cap to which the first windage tray is coupled.

In at least some implementations, the first windage tray is arranged longitudinally between the first end of the engine block and a first end of the balance shaft module, and second windage tray is longitudinally spaced from the first windage tray and is arranged longitudinally between the second end of the engine block and a second end of balance shaft module.

In at least some implementations, the second windage tray includes one or more first holes each of which receives a fastener that is coupled to the engine block, the second windage tray includes one or more second holes each of which receives a fastener coupled to the bearing cap, and the second windage tray includes one or more third holes, each of which receives a fastener coupled to the balance shaft module, and wherein the one or more third holes are arranged perpendicular to one or both of the one or more first holes and the one or more second holes.

The windage tray or trays may be directly connected to multiple components such as the engine, balance shaft module and one or more bearing caps. The connections may be accomplished with simple fasteners and the fasteners may be arranged in more than one direction, such as vertically and longitudinally, as set forth herein. Connecting the windage tray to multiple components can improve the structural integrity of the engine and can reduce noise and vibrations from the engine, and specifically, from the components coupled to the windage tray(s).

Further areas of applicability of the present disclosure will become apparent from the detailed description, claims and drawings provided hereinafter. It should be understood that the summary and detailed description, including the disclosed embodiments and drawings, are merely exemplary in nature intended for purposes of illustration only and are not intended to limit the scope of the invention, its application or use. Thus, variations that do not depart from the gist of the disclosure are intended to be within the scope of the invention.

DETAILED DESCRIPTION

Figure 1:
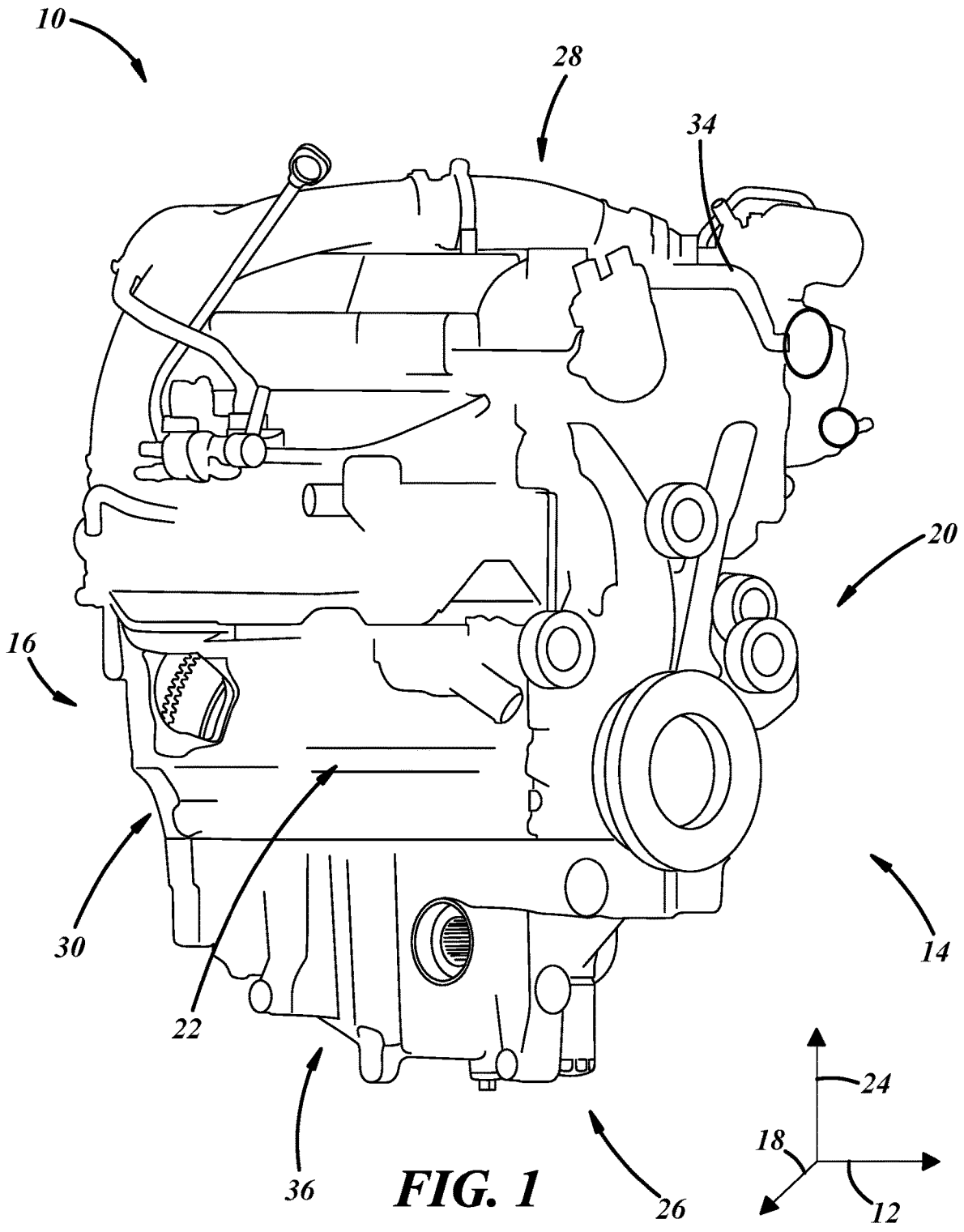
FIG. 1 is a perspective view of an internal combustion engine.

Referring in more detail to the drawings, FIG. 1 illustrates a portion of an internal combustion engine 10. The engine 10 extends longitudinally (shown by an arrow or axis 12) between a first side and a second side, which in the illustrated embodiment are a front side 14 and a rear side 16 of the engine 10, the engine 10 extends in a lateral direction (shown by an arrow or axis 18) between a first or right side 20 and a second or left side 22, and in a vertical direction (shown by an arrow or axis 24) between a bottom side 26 and an opposite top side 28. The engine 10 may be oriented in a different manner, such as transversely, and the particular orientation of the engine 10 is not limited by or within this disclosure. Use of terms like front, rear, left, right, bottom and top are for ease of description of the illustrate embodiment and are not intended to limit the innovations set forth herein.

Figure 2:
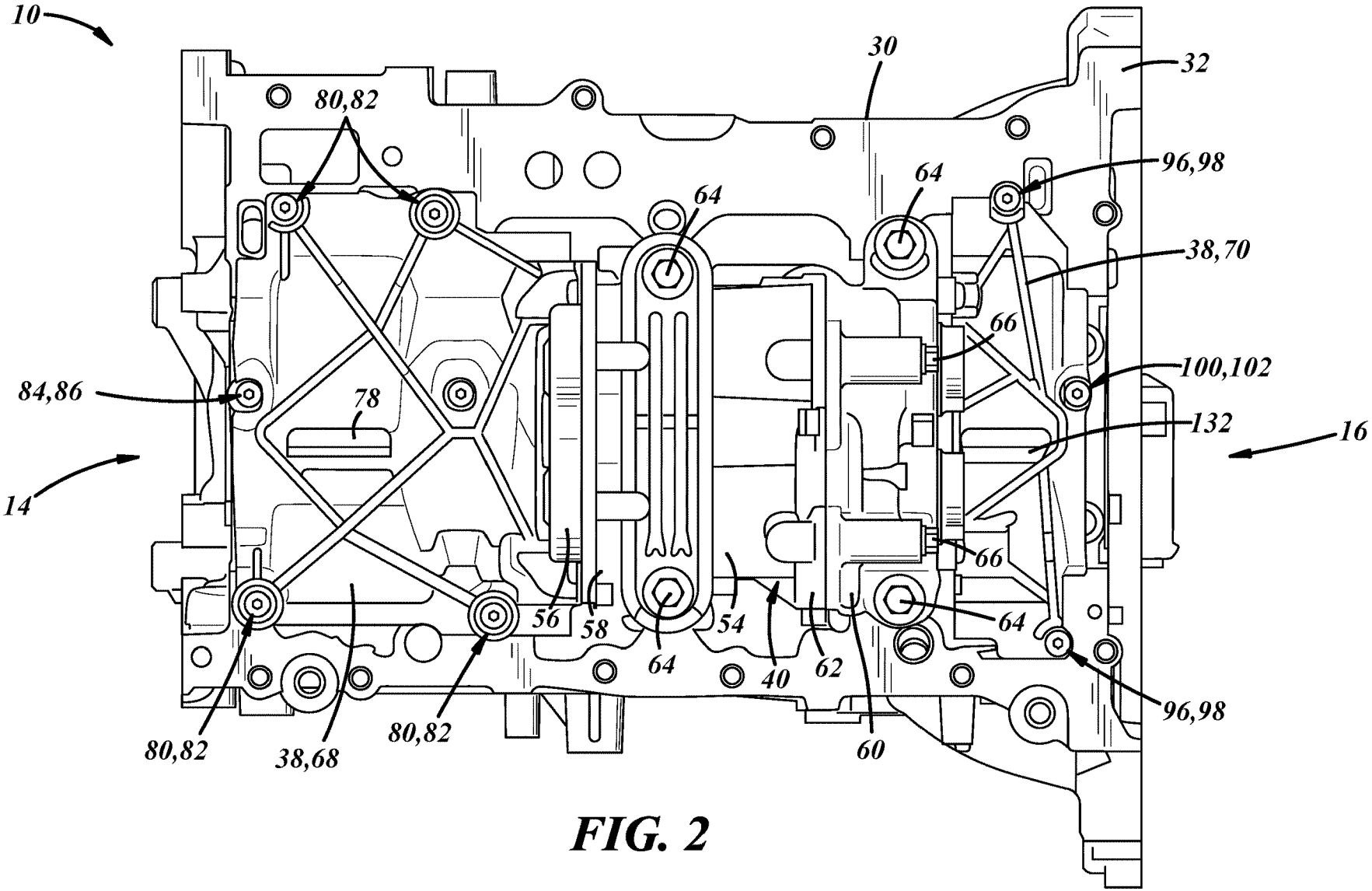
FIG. 2 is bottom view of the engine with an oil sump removed.
Figure 3:
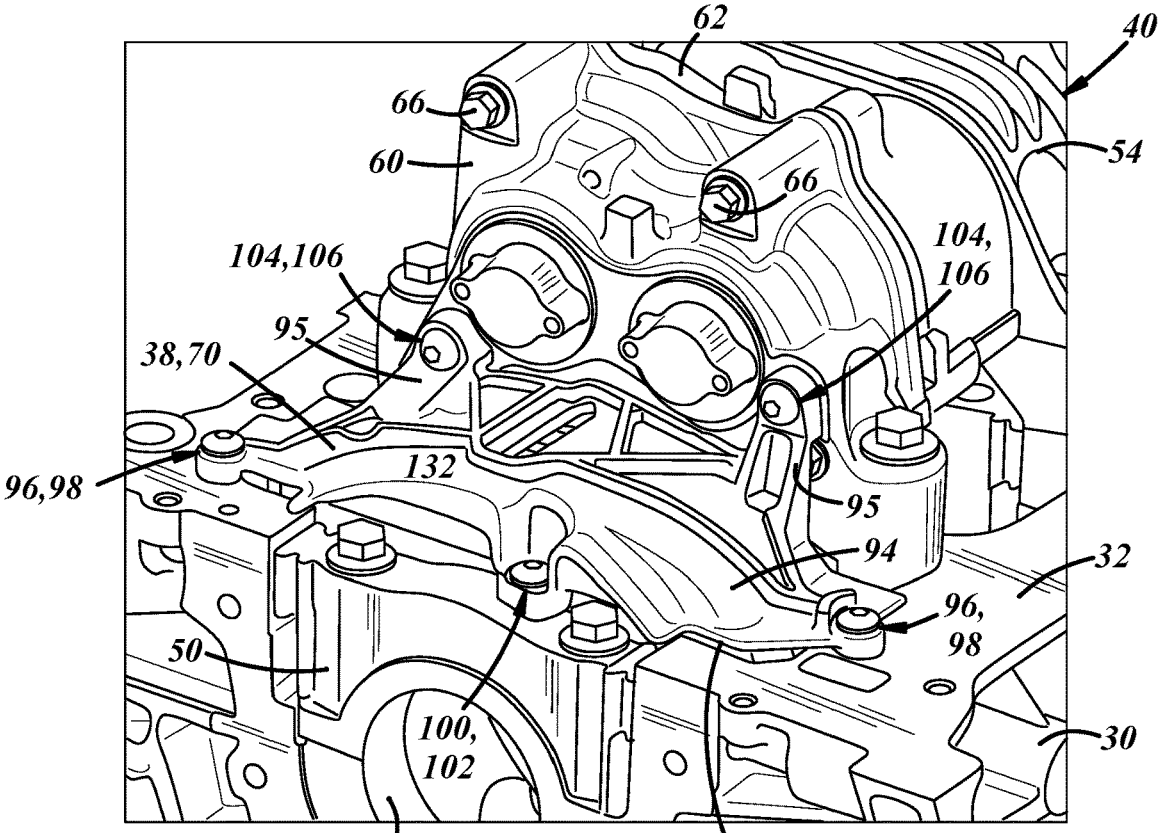
FIG. 3 is a perspective view of a rear portion of the engine with the oil sump removed.
Figure 4:
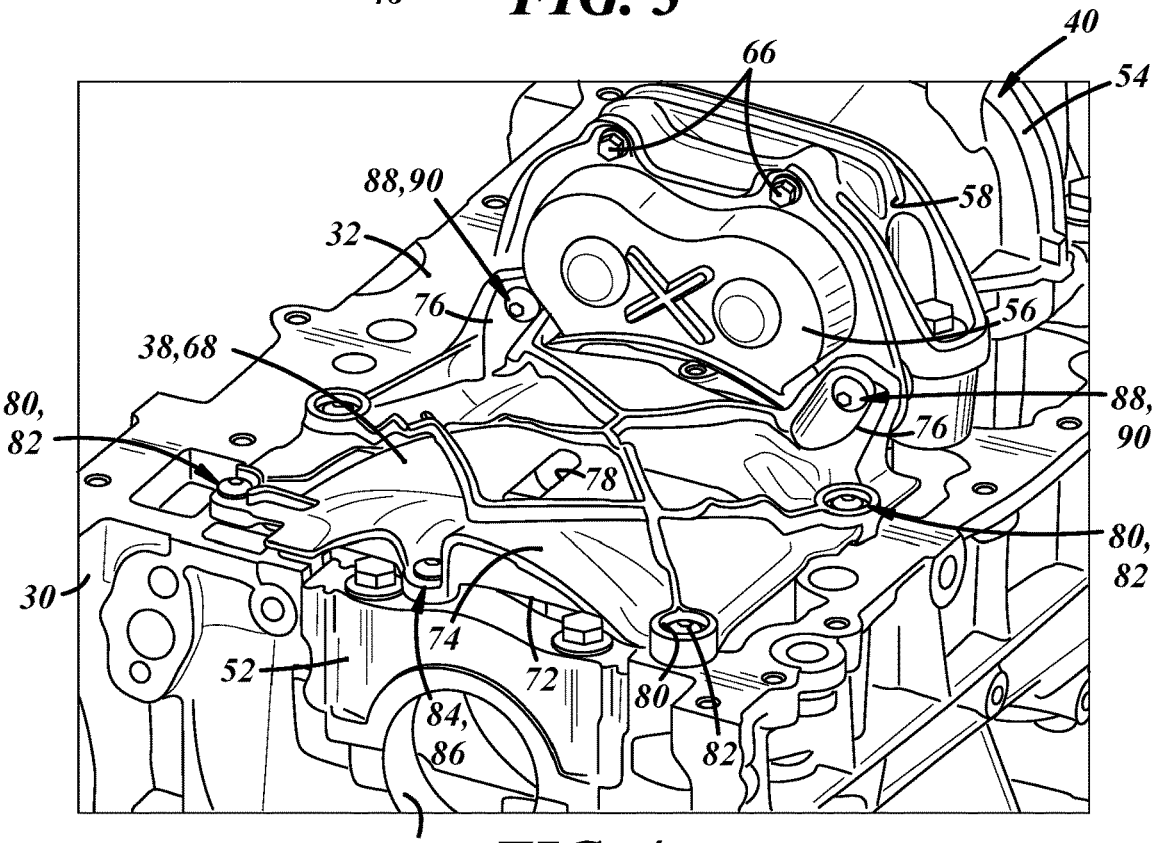
FIG. 4 is a perspective view of a front portion of the engine with the oil sump removed.

With reference to FIGS. 2 and 3, the engine 10 includes an engine block 30 that may be formed from cast metal. The engine block 30 has a bottom side that includes a mounting surface 32 and an opposite top side on which an engine head and/or cover 34 (FIG. 1) may be connected. An oil pan 36 is coupled to the mounting surface 32 of the engine block 30, and encloses with the engine block components at the bottom side of the engine block. In this regard, the bottom of the engine block may be at least partially enclosed by a windage tray 38 and a balance shaft module 40, which define part of an interior of the engine block 30. As shown in FIGS. 3 and 4, the engine block 30 also includes first and second crankshaft openings 46, 48 arranged one each at the rear side 16 and front side 14 of the engine block 30, to rotatably receive the crankshaft therein. Part of the crankshaft openings 46, 48 are defined by the engine block 30 and part of the crankshaft openings 46, 48 are defined by first and second bearing caps 50, 52 secured to the engine block 30 (e.g. by bolts), with bearings carried by the engine block 30 and bearing caps 50, 52. The bearing caps 50, 52 may be formed from metal such as aluminum or iron, by way of two examples.

With reference again to FIG. 2, the balance shaft module 40 is arranged between the front side 14 and the rear side 16 of the engine block 30 and is coupled to the mounting surface 32 (e.g. by bolts). In the illustrated embodiment, the balance shaft module 40 has a housing that includes a main body 54, a first or front cover 56 connected to a first or front side 58 of the main body 54, and a second or rear cover 60 connected to an opposite second or rear side 62 of the main body 54 that is longitudinally spaced from the front side 58. The main body 54 may be coupled to the engine block 30 by multiple bolts 64 that extend vertically and through a separate opening in the main body 54 and into a corresponding hole in the engine block 30. The front and rear covers 56, 60 may be coupled to the main body 54 by multiple bolts 66 that extend longitudinally through aligned openings in the covers and the main body 54.

With reference to FIG. 2, the windage tray 38 may be provided in more than one piece, and in some implementations such as that shown in the drawings, the windage tray 38 includes a first windage tray 68 and a separate, second windage tray 70. The first windage tray 68 may be arranged longitudinally between the front side 14 of the engine block 30 and the front cover 56 of the balance shaft module 40, and laterally between opposite sides of the mounting surface 32 of the engine block 30. As shown in FIG. 4, the first windage tray has an inner surface 72 that faces inwardly toward an interior of the engine block 30, and an outer surface 74 that faces outwardly, away from the engine block 30 and toward the oil pan 36. The first windage tray 68 may include one or more flanges 76 that extend vertically (in the vertical direction) at or adjacent to the front side 58 and the balance shaft module 40. The flange(s) 76 may be formed in the same piece of material as the rest of the first windage tray 68, which may include, for example, metal, laminate or plastic material, and/or the like. The tray 68 may also include an oil passage 78 that extends through the inner surface 72 and outer surface 74, to allow controlled flow of oil between the interior of the engine block 30 and the oil pan 36.

The first windage tray 68 may include coupling features so that the first windage tray 68 may be directly coupled to the engine 10. For example, the first windage tray 68 may include one or more first coupling features 80 that are adapted to permit attachment of the first windage tray 68 to the engine block 30. The first coupling features 80 in this example include holes that are arranged or oriented vertically through the first windage tray 68 and which receive fasteners 82 that are oriented vertically when coupled to the engine block 30. Multiple first coupling features 80 and fasteners 82 may be provided spaced along portions of the first windage tray 68 that overlap the engine block 30.

Further, the first windage tray 68 may include one or more second coupling features 84 that may be adapted to permit attachment of the first windage tray 68 to one or more bearing caps. The second coupling features 84 may include through holes that are formed vertically and which receive fasteners 86 that are oriented vertically when coupled to the bearing cap(s). The second coupling features or holes 84 may be provided anywhere the first windage tray 68 overlaps a bearing cap and where corresponding fastener openings are provided in the bearing cap(s). A portion of the flange 76 of the first windage tray 68 may extend vertically from the periphery of a rear portion of the body 86 and include one or more third coupling features 88. The third coupling features 88 may include holes formed through the flange 76 and may extend longitudinally (e.g. generally parallel to the longitudinal direction 12) for receipt of fasteners 90 that extend longitudinally.

As shown in FIG. 3, the second windage tray 70 may be arranged longitudinally between the rear cover 60 of the balance shaft module 40 and the rear side 16 of the engine block 30, and laterally between opposite sides of the mounting surface of the engine block. The second windage tray 70 has an inner surface 92 (FIG. 3) that faces inwardly toward an interior of the engine block 30, and an outer surface 94 that faces outwardly, away from the engine block 30 and toward the oil pan 36. The second windage tray may include one or more flanges 95 that extend vertically (in the vertical direction) at or adjacent to the front side 116 and the balance shaft module 40. The flange 95 may be formed in the same piece of material as the rest of the second windage tray 70, which may include, for example, metal, laminate or plastic material, and/or the like. The second windage tray 70 may also include an oil passage 132 that extends through the inner surface 92 and outer surface 94, to allow controlled flow of oil between the interior of the engine block 30 and the oil pan 36.

Similar to the first windage tray 68, the second windage tray 70 may include first coupling features 96 that may be oriented vertically to receive fasteners 98 that are oriented vertically when coupled to the engine block 30. Further, the second windage tray 70 may include one or more second coupling features 100 that permit attachment of the second windage tray 70 to one or more bearing caps. The second coupling features 100 may include through holes that are formed vertically and which receive fasteners 102 that are oriented vertically when coupled to the bearing cap(s). And the second windage tray 70 may include third coupling features 104 such as holes arranged longitudinally (e.g. generally parallel to the longitudinal direction 12) through the flange to receive fasteners 106 coupled to the balance shaft module, such as to the rear cover 60 thereof.

In at least some implementations, fasteners securing the windage trays 68, 70 to both the engine block 30 and bearing caps 50, 52 are oriented in the vertical direction, and fasteners securing the windage trays 68, 70 to the balance shaft module 40 may be inserted in a direction perpendicular to the vertical direction, and are shown as being oriented in the longitudinal direction.

So arranged, the windage tray 38, which may include one or more separate pieces or trays, is directly connected to the engine block 30, the balance shaft module 40 and at least one bearing cap 50, 52. Directly connected means that the windage tray 38 is connected to these components without a separate component of the engine between them, with the exception that seals, washers, gaskets and other such components may be provided at the interface of the windage tray(s) and the components to which the windage tray is connected, such as may be common with bolt or other fastener connections.

While described as being defined by two separate windage trays 68, 70 a single windage tray could be used that is coupled to the engine in the manner generally set forth above. That is, a single windage tray could span between the bearing caps 50, 52 at each end 14, 16 of the engine block 30, and could be coupled to the balance shaft module 40 and/or to the main body 54 of the balance shaft module 40. Further, while two bearing caps 50, 52 are shown and described, and engine 10 may include additional bearing caps and the windage tray(s) may be coupled to each bearing cap, in at least some implementations, as desired. By connecting the windage tray(s) to the engine block, balance shaft module and the bearing cap, vibrations and noise may be damped and the structural integrity of the engine improved.

What is claimed is:

1. A windage tray for an engine, the windage tray comprising:

a first body having a first coupling feature by which the first body is adapted to be coupled to an engine block, the first body having a second coupling feature by which the first body is adapted to be coupled to a bearing cap, and the first body having a third coupling feature by which the first body is adapted to be coupled to a balance shaft module, wherein the third coupling feature includes one or more holes that extend perpendicular to at least one of the first coupling feature and the second coupling feature.

2. The windage tray of claim 1 wherein the first body includes an inner surface adapted to overlie part of an interior of the engine block and an opposite outer surface, and a fluid passage formed through the first body and extending through the inner surface and the outer surface.

3. The windage tray of claim 1 wherein the first coupling feature includes holes through the first body and the second coupling feature includes holes through the first body.

4. The windage tray of claim 3 wherein the first body includes an inner surface adapted to overlie part of an interior of the engine block and an opposite outer surface, and the first coupling feature and the second coupling feature each including one or more holes that extend through the inner surface and the outer surface.

5. The windage tray of claim 4 wherein the one or more holes of the first coupling feature are each adapted to receive a fastener that is coupled to the engine block, and the one or more holes of the second coupling feature are each adapted to receive a fastener that is coupled to the bearing cap.

6. The windage tray of claim 1 wherein the first body extends in a longitudinal direction and a lateral direction, where the lateral direction is perpendicular to the longitudinal direction, and wherein the first coupling feature is arranged vertically and is adapted to receive a fastener that extends vertically into the engine block, where vertically is perpendicular to both the longitudinal direction and the lateral direction, and wherein a portion of the first body extends vertically and includes the third coupling feature which is arranged in the longitudinal direction.

7. The windage tray of claim 6 wherein the third coupling feature is vertically spaced from one or both of the first coupling feature and the second coupling feature.

8. The windage tray of claim 1 which also comprises a second body, the second body being spaced from the first body, the second body having a first coupling feature by which the second body is adapted to be coupled to an engine block, the second body having a second coupling feature by which the second body is adapted to be coupled to a bearing cap, and the second body having a third coupling feature by which the second body is adapted to be coupled to a balance shaft module.

9. The windage tray of claim 8 wherein the third coupling feature of the second body includes one or more holes that extend perpendicular to at least one of the first coupling feature of the second body and the second coupling feature of the second body.

10. An engine assembly, comprising:

an engine block having a first end, a second end spaced in a longitudinal direction from the front side, a left side extending between the first end and the second end and a right side extending between the first end and the second end and spaced in a lateral direction from the left side, where the lateral direction is perpendicular to the longitudinal direction;

a balance shaft module connected to the left side and the right side;

a bearing cap attached to the engine block; and a windage tray including one or more first holes each of which receives a fastener that is coupled to the engine block, one or more second holes each of which receives a fastener coupled to the bearing cap, and one or more third holes, each of which receives a fastener coupled to the balance shaft module.

11. The engine assembly of claim 10 wherein the one or more fasteners received in the one or more first holes are arranged in a vertical direction that is perpendicular to the longitudinal direction, and the one or more fasteners received in the one or more third holes are arranged perpendicular to the one or more fasteners received in the one or more first holes.

12. The engine assembly of claim 10 wherein the one or more fasteners received in the one or more second holes are arranged in a vertical direction that is perpendicular to the longitudinal direction and the lateral direction, and the one or more fasteners received in the one or more third holes are arranged perpendicular to the one or more fasteners received in the one or more second holes.

13. An engine assembly, comprising:

an engine block having a first end, a second end spaced in a longitudinal direction from the front side, a left side extending between the first end and the second end and a right side extending between the first end and the second end and spaced in a lateral direction from the left side, where the lateral direction is perpendicular to the longitudinal direction;

a balance shaft module connected to the left side and the right side;

a bearing cap attached to the engine block; and a windage tray including one or more first holes each of which receives a fastener that is coupled to the engine block, one or more second holes each of which receives a fastener coupled to the bearing cap, and one or more third holes, each of which receives a fastener coupled to the balance shaft module, wherein the windage tray includes a first windage tray and a separate second windage tray spaced longitudinally from the first windage tray, wherein the second windage tray is coupled by fasteners to each of the engine block, the balance shaft module and at least one bearing cap that is separate from the at least one bearing cap to which the first windage tray is coupled.

14. The engine assembly of claim 13 wherein the first windage tray is arranged longitudinally between the first end of the engine block and a first end of the balance shaft module, and second windage tray is longitudinally spaced from the first windage tray and is arranged longitudinally between the second end of the engine block and a second end of balance shaft module.

15. The engine assembly of claim 13 wherein the second windage tray includes one or more first holes each of which receives a fastener that is coupled to the engine block, the second windage tray includes one or more second holes each of which receives a fastener coupled to the bearing cap, and the second windage tray includes one or more third holes, each of which receives a fastener coupled to the balance shaft module, and wherein the one or more third holes are arranged perpendicular to one or both of the one or more first holes and the one or more second holes.

* * * * *